United States Patent [19]

Malachowski et al.

[11] 4,372,668

[45] Feb. 8, 1983

[54] SHEET REGISTRATION ACTUATION

[75] Inventors: Michael A. Malachowski, Webster; Victor Shur, Henrietta; Raghulinga R. Thettu, Webster, all of N.Y.

[73] Assignee: Xerox Corporation, Stamford, Conn.

[21] Appl. No.: 219,804

[22] Filed: Dec. 24, 1980

[51] Int. Cl.[3] ..... G03G 15/00; G03G 15/28

[52] U.S. Cl. ..... 355/3 R; 355/3 SH; 355/14 R; 355/8; 271/114

[58] Field of Search ..... 355/3 R, 3 SH, 14 R, 355/14 SH, 8; 271/10, 114, 116, 117, 246, 273, 276, 271

[56] References Cited

U.S. PATENT DOCUMENTS

| | | | |
|---|---|---|---|
| 4,132,401 | 1/1979 | Gauronski et al. | 271/245 |
| 4,135,804 | 1/1979 | Schoppe et al. | 355/3SH |
| 4,172,653 | 10/1979 | Bujese | 355/3 SH |
| 4,181,424 | 1/1980 | Okada et al. | 355/8 |

*Primary Examiner*—A. C. Prescott

[57] ABSTRACT

Reproducing apparatus with a stationary optical system, a reciprocating platen to transport a document across the stationary optical system, a copy sheet feeding apparatus and a copy sheet registration apparatus to feed a copy sheet in synchronism with the transport of a document by the platen. The platen has mechanical means such as a linear cam to actuate the copy sheet registration apparatus and the copy sheet registration apparatus is responsive to the platen actuating means to directly actuate the copy sheet registration apparatus.

10 Claims, 14 Drawing Figures

45
49
67
49
68
62
66
65
49
61
63
27
60
57
49
58
50
51
46
47
56
52
50
50
55
75
44
76

SHEET REGISTRATION ACTUATION

REFERENCE TO RELATED APPLICATIONS

Reference is hereby made to the following copending applications filed concurrently herewith: U.S. Ser. No. 219,691 entitled "AUTOMATIC REPRODUCING APPARATUS" and filed by Edward J. Gunzelmann, Raghulinga R. Thettu and Larry M. Wood; U.S. Ser. No. 291,690 entitled "SHEET FEEDING APPARATUS" and filed by Victor (NMI) Shur and Raghulinga R. Thettu; U.S. Ser. No. 219,692 entitled "SHEET FEEDING AND REGISTRATION APPARATUS" and filed by Victor (NMI) Shur and Raghulinga R. Thettu.

BACKGROUND OF THE INVENTION

This invention relates to automatic reproducing apparatus and in particular to sheet feeding and registration apparatus. Specifically, the present invention is directed to a simple mechanical actuation mechanism for a sheet separation, registration and feeding apparatus.

The development of automatic reproducing machines and, in particular, electrostatographic copiers has most frequently involved the use of paper feeding and registration systems using a set of pinch rolls or two pinch rolls with a stop or registration gate. These systems typically involve the application of high normal forces to the stack of sheets to insure separation and the feeding in the forward direction of the topmost sheet. In addition, with these systems, the topmost sheet is typically driven into contact with the stop of registration member to first register the lead edge of the sheet prior to the sheet being fed to the imaging or image transfer station. While the lead edge is constrained during this registration operation, the high normal force feeders continue to feed the sheet in the forward direction creating a buckle within the sheet and increasing the possibility of damaging the lead edge of the sheet by way of tearing or wrinkling as it is continuously driven into a stop surface. Furthermore, after the top sheet has been separated from the stack of sheets, some systems interrupt the driving motion of the feed rolls to reduce the possibility of damage to the a sheet are relatively complex and costly. However, perhaps the most significant difficulty with these systems is that a chamber must be made available for the sheet being registered against the stop to buckle without wrinkling. This is particularly significant in the design of small copiers which typically attempt to maximize the use of space to keep the overall volume of the copier to a minimum.

An alternative to the high normal force sheet feeders are the inertial feeders which have a high acceleration and a low normal force on the top sheet being fed. In this type of feeding arrangement, devices are used to continuously urge the top sheet in the stack in a forward direction with relatively high acceleration but with relatively low normal force and therefore reduce possibility of damage. Typical of such inertial feeding devices are the continuous rotating flexible paddle wheel feeders. In these devices, as soon as the trailing edge of the top sheet in a stack of sheets clears the feeding device, the second and next successive sheet is fed forward. If the top sheet is being registered further down the sheet feeding path or if the top sheet has just cleared a nearby retracted registration stop member, there is the possibility of the second sheet being fed along with the top sheet beyond the registration edge. One way of avoiding this is to interrupt the feeding motion of the paddle wheel feeder, for example, with a clutch for every sheet being fed. Such clutch driven systems are more complicated and expensive to manufacture and maintain. The inertial sheet feeders provide a good choice for small compact copiers since they are relatively simple and inexpensive and require very little machine volume.

One way to classify small compact copiers is with regard to the position of the document during imaging. Some copiers have a flat, stationary document platen and a scanning optical system to transmit the image of the intelligence on the document to the imaging surface. Other copiers use a moving platen arrangement which transports a document past a stationary optical system which transmits the image to the imaging surface. In the first group of machines the actuation of the sheet feeding and registration mechanism is typically tied to the movement of the optical system through the use of some complex mechanical or electromechanical device. In this latter group of machines, the feeding of the copy paper is tied into, or somehow synchronized, with the feeding of the document. The problem sought to be solved with these devices is how to timely actuate the paper feed and registration system together with the document transport system. Various electrical and electromechanical arrangements have been used for this purpose. Typical of the systems proposed are those which sense the leading edge of the document being transported and together with some timing device actuate the paper feeder which itself may be driven through an electromagnetic clutch arrangement. Such systems are both complex and expensive and add to the overall manufacturing time and cost.

PRIOR ART

U.S. Pat. No. 4,181,424 describes a reproducing apparatus with a moving document platen transport and a paper transport where the document transport and the copy paper feed systems are synchronized with a complex mechanical timing and actuation mechanism for intermittent paper by feeding to the registration stop member. U.S. Pat. No. 4,172,653 describes a reproducing machine with a moving document platen transport where the copy sheet feed rollers are drivingly connected to a motor when the platen transport is in the home position. The feed rollers are disconnected from the motor when the platen transport leaves the home position. U.S. Pat. No. 4,132,401 describes a document handling system where the document is pre-registered at a pre-registration gate associated with pre-registration drive rolls. Once the sheet is pre-registered, the pre-registration gate is moved out of position and the document is driven forward to independently operated registration gates. As soon as registration is complete, the registration pinch rolls pinch the lead edge of the document against a vacuum belt transport. U.S. Pat. No. 4,135,804 describes a registration apparatus where a copy sheet stop register member is movable into and out of the path of sheet travel. The stop member has a chute portion with a resilient strip attached to it for urging the sheet against a lower sheet guide.

SUMMARY OF THE INVENTION

In accordance with this invention a reproducing apparatus with a stationary optical system, a reciprocating platen to transport a document across the stationary optical system, a copy sheet feeding apparatus and a copy sheet registration apparatus to feed a copy sheet in synchronism with the transport of a document by the platen is provided. The platen has mechanical means such as a linear cam to actuate the copy sheet registration apparatus and the copy sheet registration apparatus is responsive to the platen actuating means to directly actuate the copy sheet registration apparatus.

More particularly, an actuation push rod assembly is urged into the cam track on the platen and is movable in response to contact with the cam profile with its opposite end actuating the separation and registration gate assembly. The present invention is directed to a relatively simple, inexpensive and accurate apparatus for actuating the sheet separation and registration apparatus of a reproducing machine.

Accordingly, it is an object of the present invention to provide a novel sheet feeding and registration apparatus.

It is a further object of the present invention to provide a novel separation gate and registration gate actuating apparatus.

It is a further object of the present invention to provide a compact, simple, inexpensive accurate and reliable separation or registration gate actuating apparatus.

It is a further object of the present invention to provide an actuating apparatus for a dual function sheet separating and registration apparatus.

It is a further object of the present invention to provide a dual function single element sheet separation and registration apparatus.

It is a further object of the present invention to provide a copy sheet feeding and registration apparatus in which the feeding of sheets to the transfer station is accurately timed and synchronized to the transport of a document across the optical exposure system.

For a better understanding of the invention as well as other objects and further features thereof, reference is had to the following drawings and description.

DETAILED DESCRIPTION OF THE INVENTION

The invention will now be described by reference to a preferred embodiment of the sheet feeding apparatus.

Figure 1:
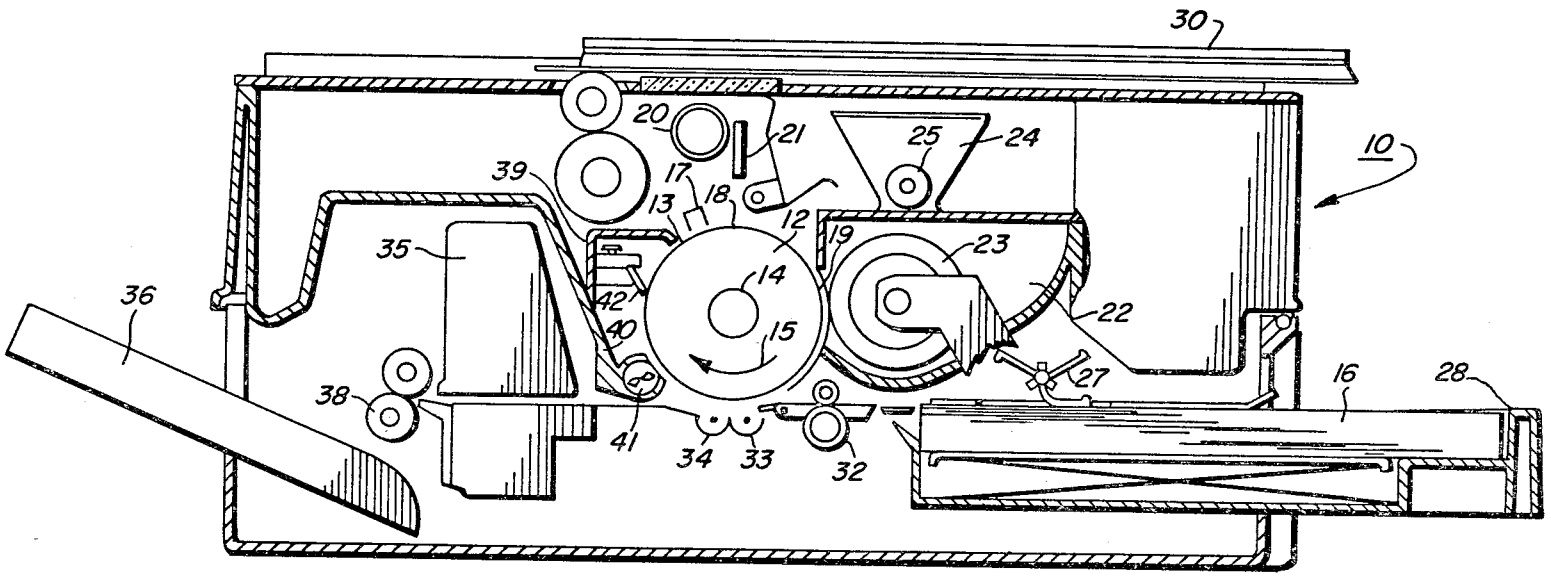
FIG. 1 is a schematic representation in cross-section of the operational elements of an automatic reproducing machine that may be assembled according to the present invention.

Referring now to FIG. 1 there is shown by way of example the operational element organizational geometry of an automatic xerographic reproducing machine 10 which may use the integrated frames and sheet guides of the present invention. The integrated frames and sheet guides themselves may be more clearly seen with reference to FIGS. 2, 3A, 3B, 3C and 4. The reproducing machine 10 depicted in FIG. 1 illustrates the various operational elements and components utilized for producing copies from an original document. Although the apparatus of the present invention is particularly well adapted for use in an automatic xerographic reproducing machine 10, it should become evident from the following description that it is equally well suited for use in a wide variety of processing systems including other electrostatographic systems and it is not necessarily limited in the application to the particular embodiment or embodiments shown herein.

The reproducing machine 10, illustrated in FIG. 1 employs an image recording drum-like member 12, the outer periphery of which is coated with a suitable photoconductive material 13. The drum 12 is suitably journaled for rotation within a machine frame (not shown in this Figure) by means of shaft 14 and rotates in the direction indicated by arrow 15 to bring the image-bearing surface 13 thereon past a plurality of xerographic processing stations. Suitable drive means (not shown) are provided to power and coordinate the motion of the various cooperating machine components whereby a faithful reproduction of the original input scene information is recorded upon a sheet of final support material 16 such as paper or the like.

Initially, the drum 12 moves the photoconductive surface 13 through a charging station 17 where an electrostatic charge is placed uniformly over the photoconductive surface 13 in known manner perparatory to imaging. Thereafter, the drum 12 is rotated to exposure station 18 where the charged photoconductive surface 13 is exposed to a light image of the original input scene information whereby the charge is selectively dissipated in the light exposed regions to record the original input scene in the form of an electrostatic latent image. At the exposure station, the image received on the drum is one which is formed by illuminating the document on the moving platen 30 by exposure lamp 20 and transmitting the image through lens assembly 21 to the photoconductor surface. The lens assembly comprises a bundled array of gradient index optical fibers which are produced under the trade name "SELFOC" in Japan by Nippon Sheet Glass Co., Ltd. and which are described in U.S. Pat. No. 3,658,407 to Kitano et al. After exposure, drum 12 rotates the electrostatic latent image recorded on the photoconductive surface 13 to development station 19 wherein a conventional developer mix is applied to the photoconductive surface of the drum 12 rendering the latent image visible. Typically a suitable development station could include a developer housing 22, a magnetic brush development roll 23 utilizing a magnetizable developer mix having coarse ferromagnetic carrier granules and toner colorant particles which is dispensed from dispenser 24 by dispenser roll 25.

Sheets 16 of the final support material are supported in a stack arrangement on an elevating stack support tray 28. With the stack at its elevated position a sheet separator feed paddle wheel 27 feeds individual sheets therefrom to the registration system 32. The sheet is then forwarded to the transfer station 33 in proper registration with the image on the drum. The developed image on the photoconductive surface 13 is brought into contact with the sheet 16 of final support material within the transfer station 33 and the toner image is transferred from the photoconductive surface 13 to the contacting side of the final support sheet 16. Following transfer of the image the final support material which may be paper, plastic, etc., as desired is transported through detack station where detack corotron 34 uniformily charges the support material to separate it from the drum 12.

After the toner image has been transferred to the sheet of final support material 16 the sheet with the image thereon is advanced to a suitable fuser 35 which coalesces the transferred powder image thereto. After the fusing process the sheet 16 is advanced to a suitable output device such as tray 36 by output rolls 38.

Although a preponderance of toner powder is transferred to the final support material 16, invariably some residual toner remains on the photoconductive surface 13 after the transfer of the toner powder image to the final support material. The residual toner particles remaining on the photoconductive surface 13 after the transfer operation are removed from the drum 12 as it moves through a cleaning station 39 which includes cleaner housing 40 and auger 41. The toner particles may be mechanically cleaned from the photoconductive surface 13 by any conventional means as, for example, by the use of a cleaning blade 42.

Normally, when the copier is operated in a conventional mode, the original document to be reproduced is placed image side down upon a horizontal transparent viewing platen 30 and the original is then transported by way of the moving platen which rides on rails (not shown) past the stationary optical system.

As the document is transported past the optical system the copy sheet is delivered to the transfer station at the same speed so that a faithful reproduction may be obtained. This is accomplished through the use of a continuously rotating paddle wheel feeder 27 which drives successive sheets from a stack into the registration system 32 which first registers the sheets and then drives them forward at a speed synchronized to that of the document transport.

It is believed that the foregoing general description is sufficient for purposes of the present application to illustrate the general operation of an automatic xerographic copier 10 which can embody the apparatus in accordance with the present invention.

Figure 2:
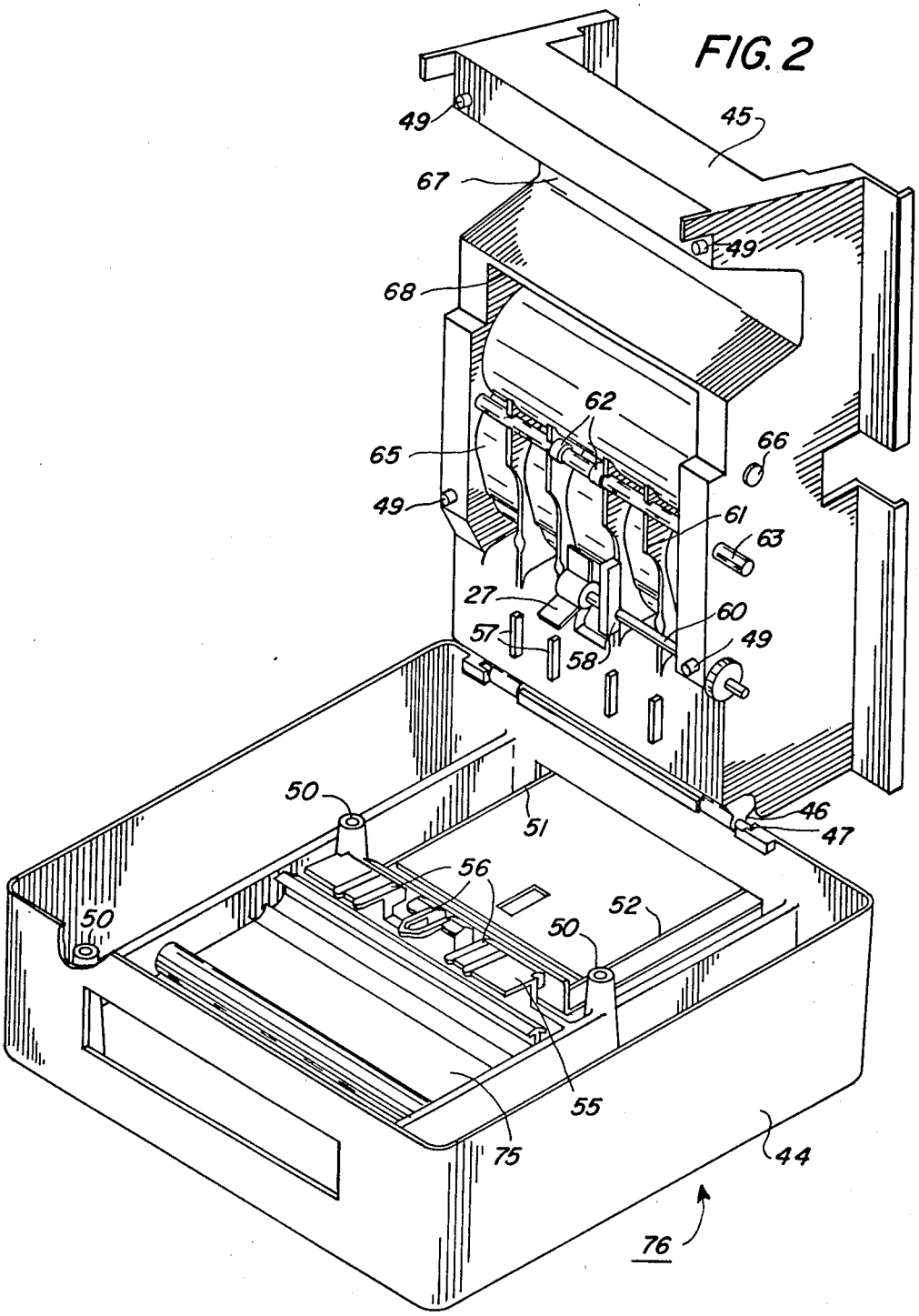
FIG. 2 is an isometric view of the upper and lower frame members opened to show the integrated nature of the top sheet guides and lower registration platen.
Figure 3A:
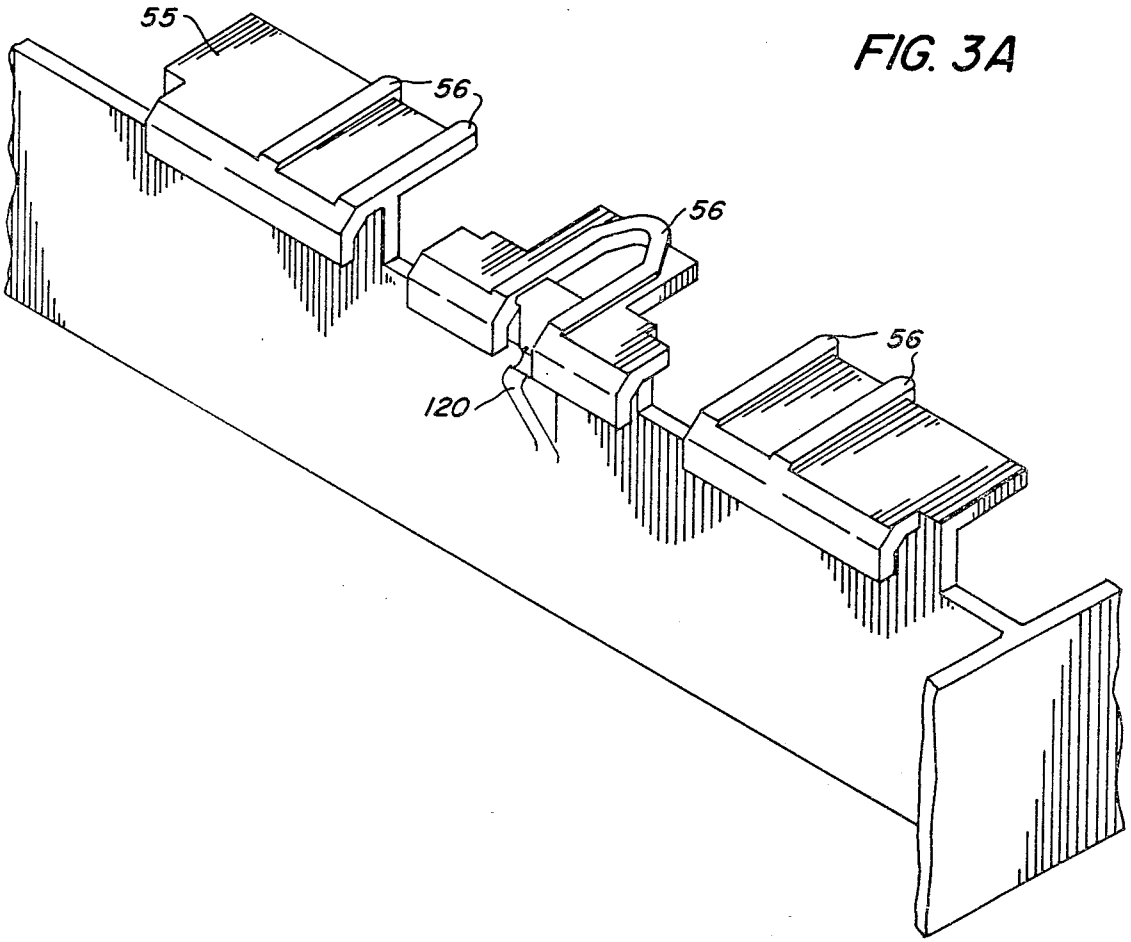
FIG. 3A is an enlarged isometric view of the lower registration platen with sheet bottom guiding elements.
Figure 3B:
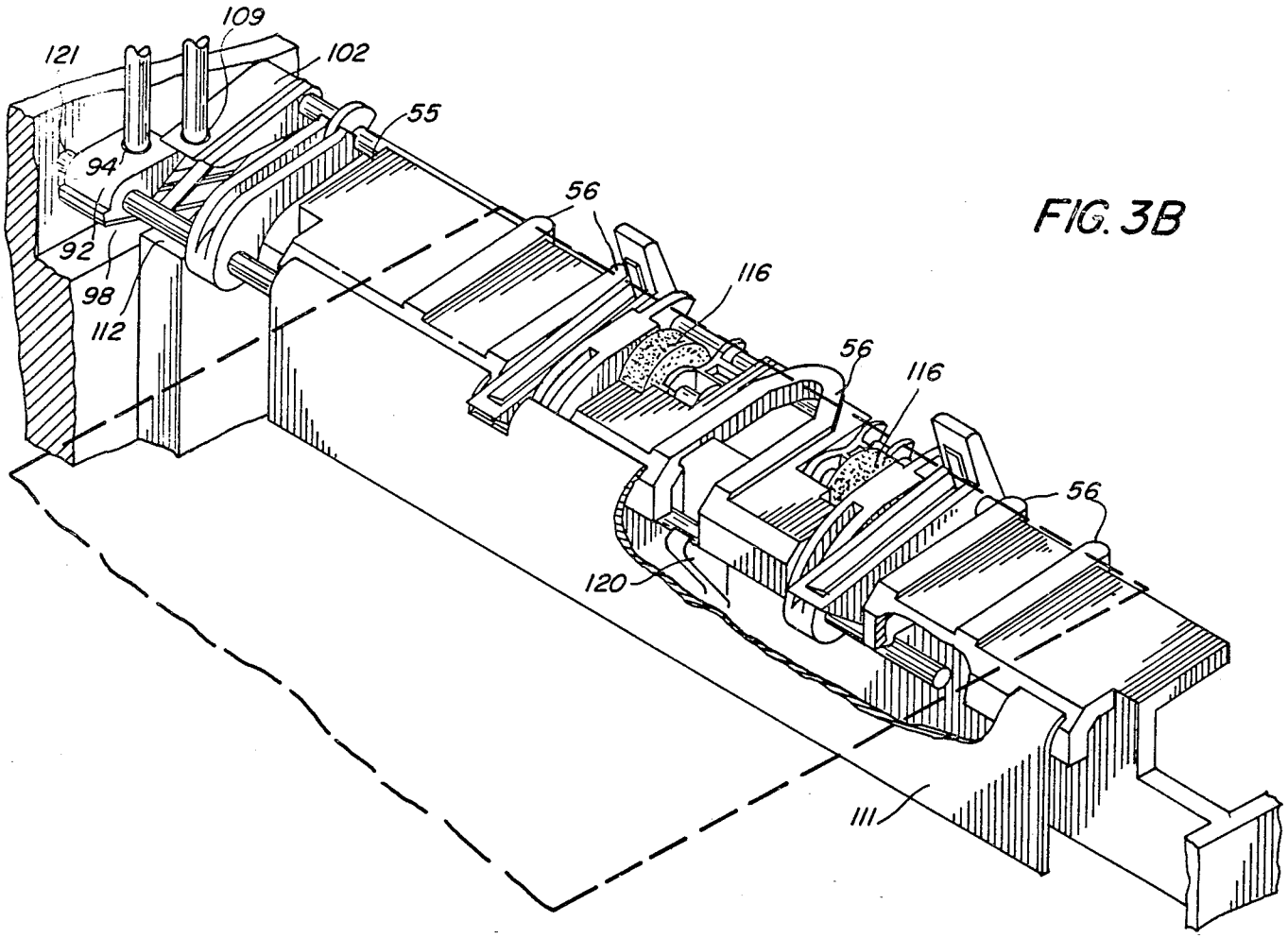
FIG. 3B is an isometric view from the rear of the lower registration platen with the separation registration gate assembly inserted therein and part of the sheet guide broken away.
Figure 3C:
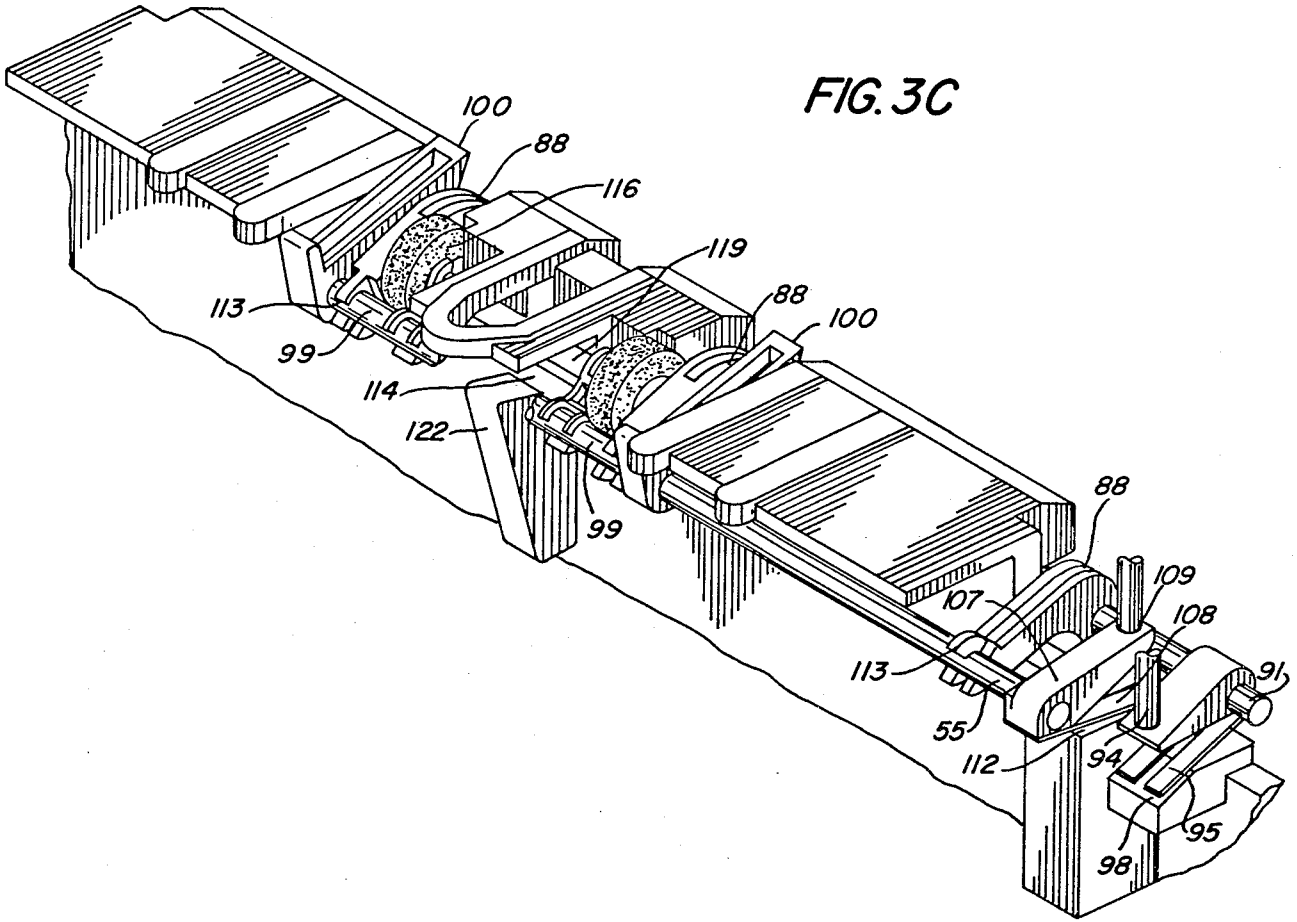
FIG. 3C is an isometric view from the front of the lower registration platen with the separation registration gate assembly inserted therein.

Referring more particularly to FIG. 2 where the integrated frame and sheet guiding elements are illustrated in greater detail, lower frame member 44 and upper frame member 45 are each one piece of molded plastic and are mounted or hinged in clamshell fashion about integrally molded hinge members 46 and 47 at the copy sheet cassette insertion end of the reproducing machine. Such hinging action provides ready access to the machine copy sheet path. The upper and lower frame members have the operational elements of the reproducing machine precisely located in the integrally molded plastic frame structure. The upper and lower frames when they are closed are accurately positioned relative to each other by upper datum pins 49 and lower datum pin supports 50. With such precision positioning between the four datum points, all the cooperating operational elements in both the upper and lower frame members are precisely mounted relative to each other. The top of the lower frame member and the bottom of the upper frame member provide a sheet transport path in the closed position. As is more readily depicted in FIG. 1, this path is a relatively straight path from the copy sheet supply tray 28 to the copy sheet output tray 36. With reference once again to FIG. 2, the lower frame member 44 has an opening 51 through which a copy sheet supply tray may be partially inserted into its body. Upon insertion the copy sheet supply tray is guided by lower tray guide members 52 into a fixed position against the lower registration platen 55 and held in position by small magnets (not shown) mounted on the side of the lower registration platen.

The lower registration platen 55 which is shown in greater detail in FIG. 3, is integrally molded into lower frame member 44 and provides a series of copy sheet guiding elements 56 in the form of raised ribs above the platen. In addition, molded directly into the sides of the registration platen are the snap mounts for mounting the separation registration gate assembly.

The cooperating paper handling structure in the upper frame member 45 includes a first set of guiding elements or ribs 57 which guide the top of the cassette into the machine frame. Secondly the mounts 58 are integrally molded in the upper frame for the paddle wheel feeder 27 and its drive shaft 60. It should be noted that neither the paddle wheel 27 or its drive shaft are integrally molded in the upper frame but rather are separate. Just beyond the paddle wheel in the sheet feeding direction are the second set of upper sheet guiding elements or ribs 61 which cooperate with lower copy sheet guiding elements 56 in insuring that the copy sheet is flat and can be accurately fed first to the registration gate and secondly to the transfer station. This unique cooperation between the integrally molded ribs of the lower and upper sections minimizes the possibility of copy sheet jams or damage to the copy sheets. More specifically, the upper sheet guides prevent the paper from entering the developer zone and in addition guide the sheet into the registration assembly and transfer zone. The lower guides prevent paper from entering the transfer and detack corotrons and also guide the sheet into the registration assembly and transfer zone. Positioned within the upper guiding elements are continuously driven feed roll 62 driven by shaft 63 which is driven by means not shown and which cooperates with movable pinch rolls which will be described with reference to the separation registration gate assembly.

The copy sheet separation and registration apparatus is illustrated with continued reference to FIG. 3 and additional reference to FIGS. 4, 5A–5D and FIG. 6. The separation and registration assembly includes three subassemblies, an arm assembly, a gate assembly and a rocker assembly as illustrated in the unassembled view of FIG. 6. The arm assembly comprises three support arms 88 outsert molded on arm shaft 91. The term outsert molded as used herein is intended to refer to those items produced when a metal shaft is actually placed in the mold and the fluid plastic is then injected into the mold. In this way a very tight fit can be assured between the plastic arms and the metal shaft. At the end of the arm shaft 91 is the arm spring 92 also outsert molded onto the shaft. The arm spring comprises an upper support member 93 having a dimple 94 in its top into which the activation push rod may be inserted as will be described later. Fastened to the bottom of the upper support members are spring leafs 95 which when the separation registration assembly is inserted into the integrated registration platen 55 of the lower frame 44 rests on frame mount 98.

The gate assembly includes a gate arm 99, two separation registration gates 100 and a gate spring 102 all outsert molded on the gate arm 99. Each of the separation registration gates includes a first separation edge 105 and a second registration gate 106. The gate spring 102 includes gate support member 107 having a dimple 109 in its top into which an actuation rod may be inserted and spring leaf 108 mounted at the bottom and which when the separation registration assembly is inserted into the integrated registration platen 55 of the lower frame 44, rests on frame 112. The gate arm 99 snaps into molded plastic snap mounts 113 at the end of the three support arms 88.

Figure 4:
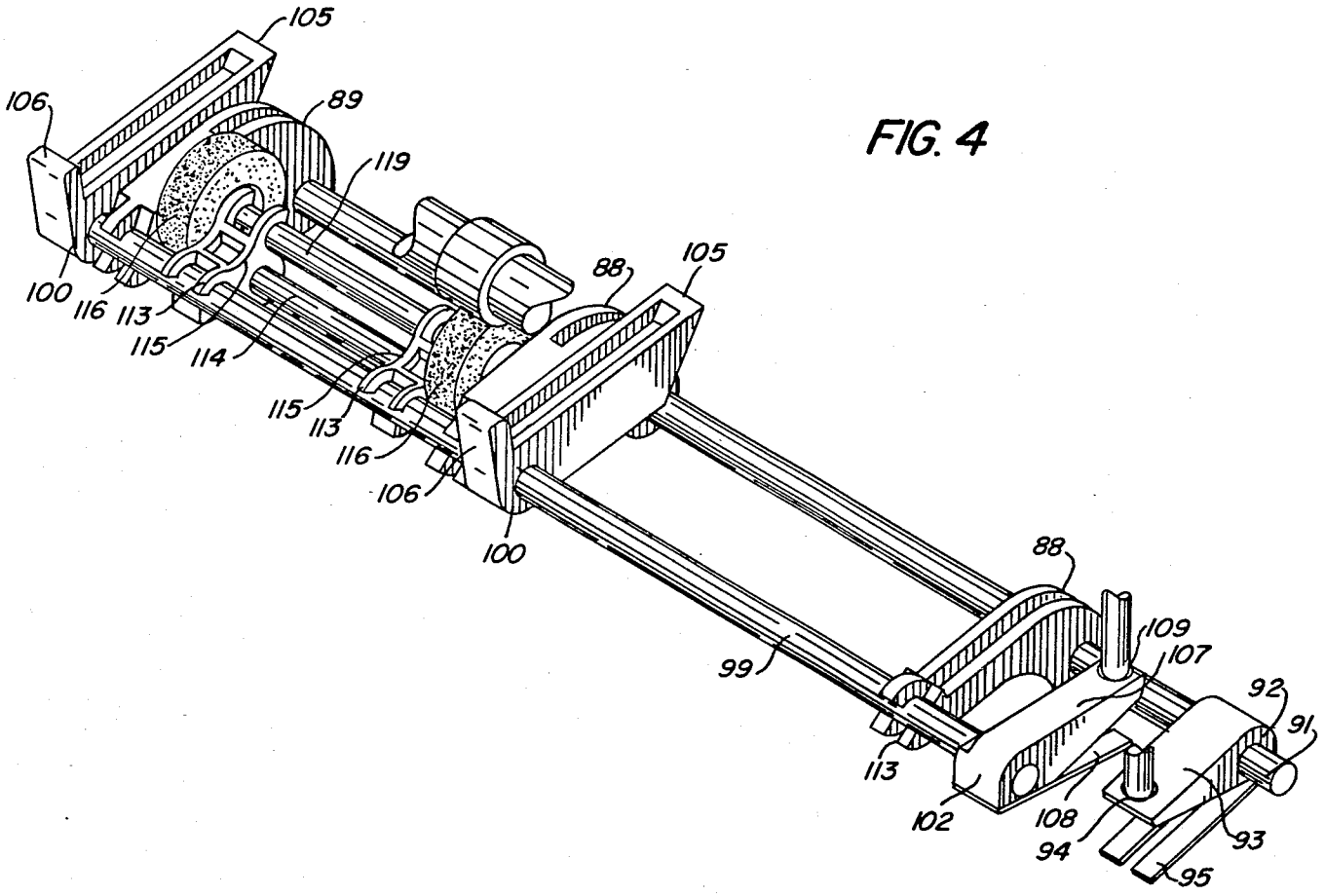
FIG. 4 is an isometric view of the separation registration assembly.

The rocker assembly 87 includes rocker shaft 114 to which are outsert molded two yoke support members 115. The yoke support members have two snap fittings at each end, one for the gate arm 99 and one for the pinch roll arm 119. The pinch roll arm with pinch rolls 116 is inserted into the snap fitting on the yoke 115 to provide the entire assembly as seen in FIG. 4. As may be seen with reference to FIG. 3B when mounted in the registration platen assembly, the arm shaft 91 snap fits into three holders 120 molded into the frame just under the registration platen and into end support 121. The arm spring 92 and gate spring 102 are also positioned to rest on frame mounts 98 and 112 respectively. In addition, the rocker shaft 114 rests on rocker ramp 122 (See FIGS. 5A–5D).

Figure 5A:
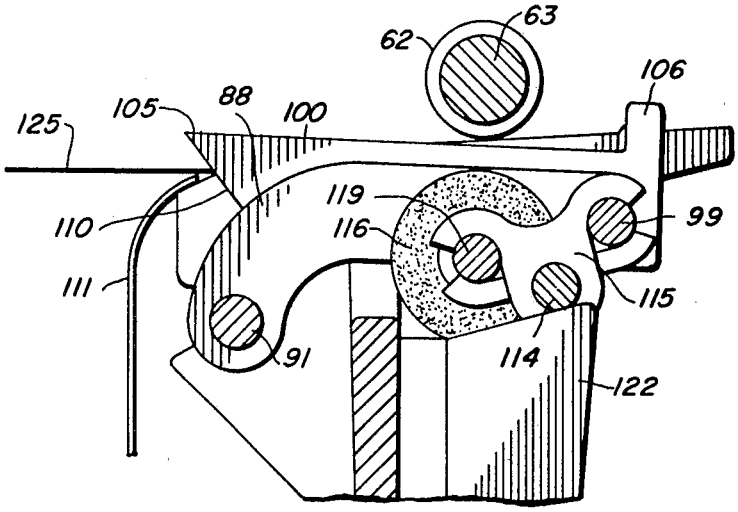
FIGS. 5A, 5B, 5C and 5D are side views of the sheet separation registration apparatus showing four positions of the separation edge and the registration gate.
Figure 5B:
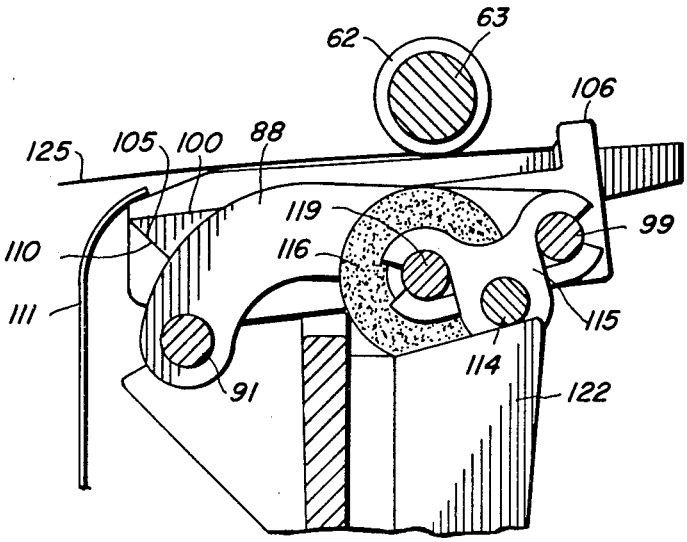
Figure 5C:
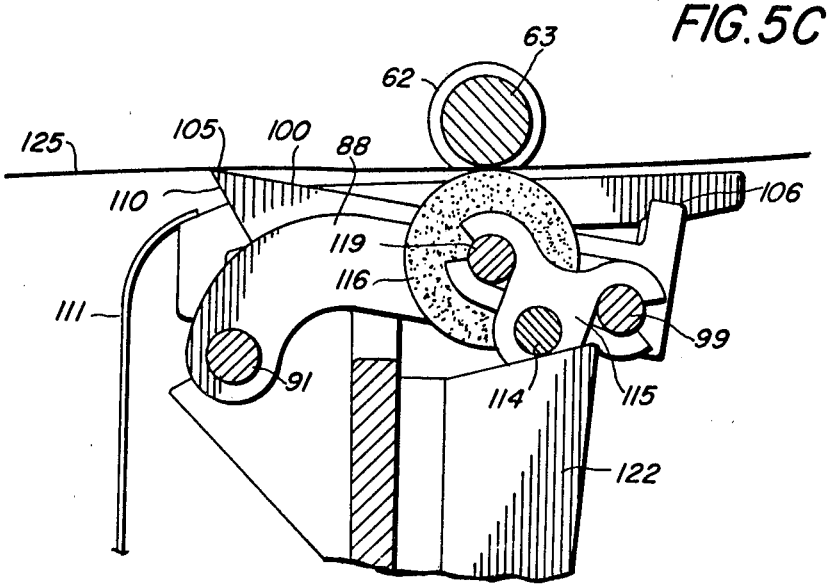
Figure 5D:
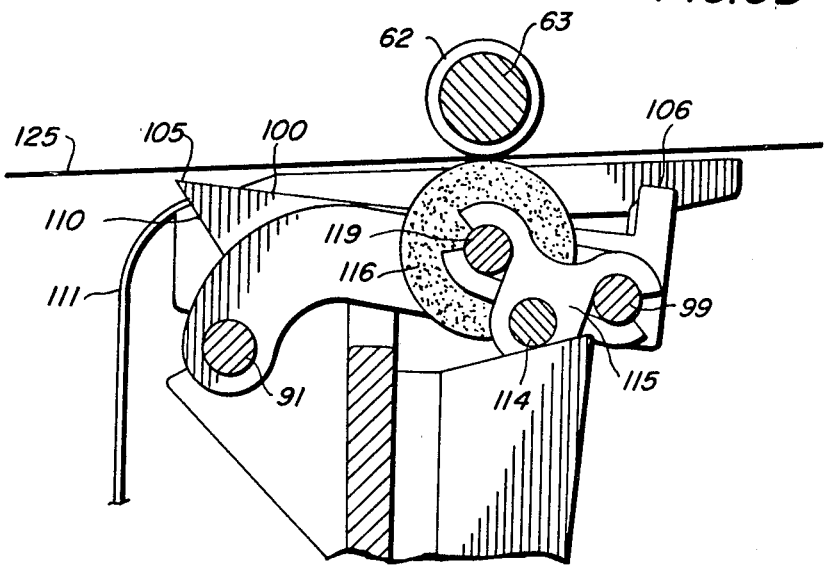
Figure 6:
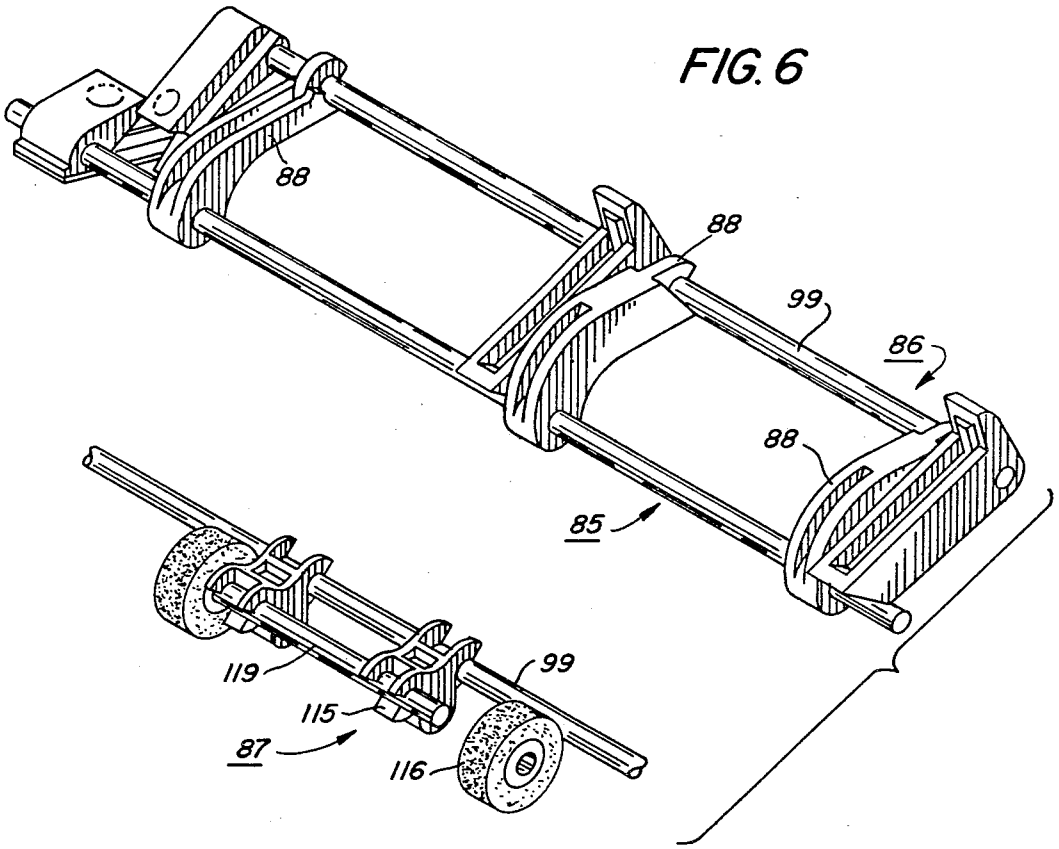
FIG. 6 is an isometric view of the separation registration assembly with the rocker assembly removed.

The separation registration action when in operation may be more clearly seen with reference to FIGS. 5A, 5B, 5C and 5D. The entire assembly is pivotally mounted on arm shaft 91 with the arm spring 92 and gate spring 102 resting on frame mounts 98 and 112 respectively with activation solely by the push rods in dimples 94 and 109 (See FIGS. 3B and 3C). FIG. 5A illustrates the standby condition with neither the arm or gate spring being depressed and with a sheet of paper 125 being held by the separator edge 105. At the start of scan or registration position in FIG. 5B, a push rod has depressed the spring on the end of the gate arm thereby lowering the separation gate 105 and bringing the full registration gate 106 to its upright position. In this position the lead edge of the sheet being fed may be registered against the registration gate. Immediately following registration as depicted in FIG. 5B, a push rod depresses arm spring 92 and the gate assembly pivots about arm shaft 91 withdrawing registration gate 106 below the level of the paper as may be seen in FIG. 5C. In addition, with the rocker shaft 114 held stationary by the rocker ramp 122 and the gate arm 99 rotated clockwise, the pinch roll arm rotates clockwise also driving pinch rolls 116 into contact with continuously driven feed rolls 62 thereby driving the registered sheet forward. In the attitude shown in FIG. 5C and with any continuously driven paper separation feeder such as the continuously rotating paddle wheel feeder herein illustrated, after the trailing edge of the sheet being fed clears the separation gate, the next sheet is driven into the separation gate. In some instances the high degree of rotation of the registration gate 106 clockwise drives the separation gate 105 up to a level that the sheet being fed contacts the guide elements on the bottom of the upper frame producing corrugations in the paper and perhaps permitting the second sheet to become wedged under the separation gate. To prohibit this from happening the position of the gates may be corrected slightly by having the push rod depressing the gate arm slightly so that the gate spring comes to a level to maintain the optimum level of the separation gate. This is called the kinematic correction factor and is illustrated in FIG. 5D. This gate assembly while being simple and compact, has the additional advantage of readily sequentially performing the three functions of sheet separation, sheet registration and sheet feeding as the pinch rolls are raised into contact with the feed rolls.

Figure 7:
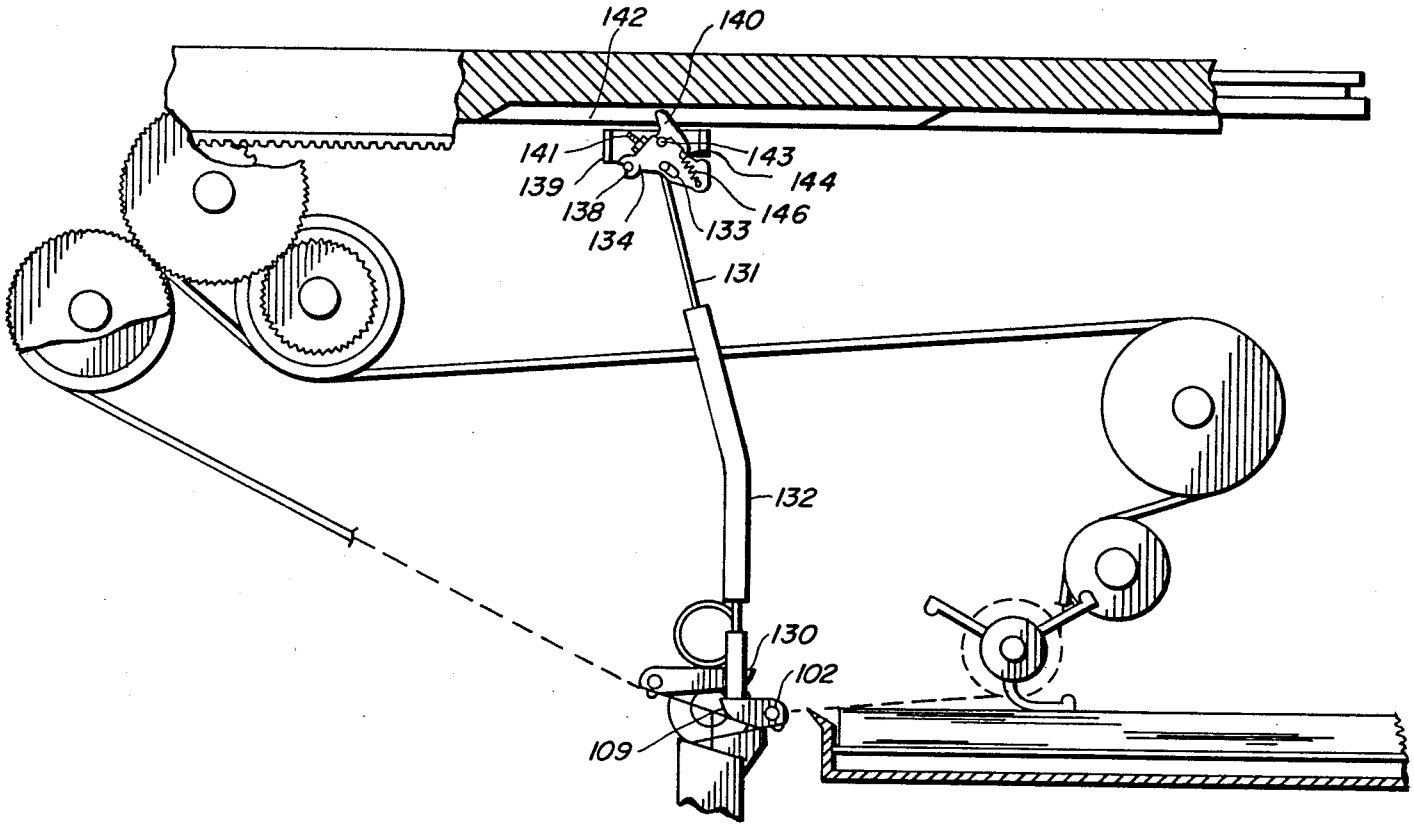
FIG. 7 is a representative side view of the document transport, sheet feed apparatus and separation registration gate actuation assembly.
Figure 8:
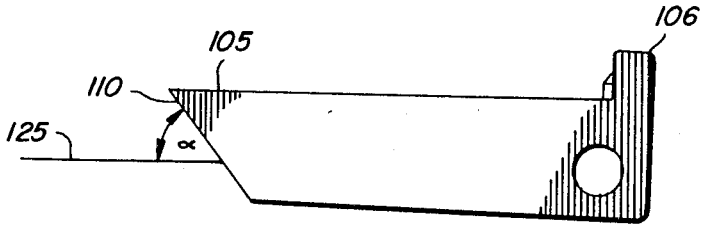
FIG. 8 is a side view of the linear reciprocating cams that actuate the push rod for actuating the sheet separation registration gate.

As mentioned briefly earlier, the separation gate assembly is activated by a push rod arrangement more fully described with references to FIGS. 7 and 8. There are two push rods, one for each of the arm spring 92 and the gate spring 102 which are controlled by a linear reciprocating cam mounted underneath the moving document platen on one side. Thus as the moving platen transports a document to be reproduced past a scanning slit, from left to right, the linear cam on the underside of the platen rail is used to activate the copy sheet separation and registration system so that a sheet may be fed in registration from right to left.

FIG. 7 shows one of the push rod assemblies, the second assembly being parallel to the one depicted and of the same construction. At the lower end a bullet 130 attached to one end of the push rod 131 rests in dimple 109 of gate spring 102 and the gate spring urges the push rod up so that the cam follower remains in contact with the cam track 142. A plastic sleeve 132 protects the push rod and supports it and guides the push rod while the sleeve is firmly mounted in a casting in the upper frame. The top end of the push rod 131 rests in a slot 133 in the cam follower assembly side plate 134 which is pivotally mounted about axis 138 in a housing 139 which is fixedly attached onto the upper frame. A cam follower 140 is pivotally attached to the side plate 134 at pivot point 143. With both the cam follower 140 and the push rod being attached to the side plate, the adjustment of the total length of actuation arm may be controlled by adjustment screw 141 which adjusts the location of the push rod 131 in the slot 133 and thereby the total length of the actuation arm. The cam follower 140 rides in cam track 142 and pushes the push rod down when it hits an elevated portion in the cam track thereby depressing the gate spring. The push rod mechanism is designed to function in one direction only while the linear reciprocating cam attached to the moving platen moves in a scan and rescan direction. In the embodiment depicted in FIG. 7 the cam follower is angled such that it operates when the cam is driven to the right. Thus during scanning of the platen to the right a raised portion of the cam track passing the stationary cam follower will drive the push rod down. On the rescan to the left the cam follower 140 which is pivotally mounted about pivot point 143 is knocked or flopped down by the raised portions of the cam track without activating the push rod. To insure that the cam follower is in the angled upright position on a subsequent scan, a spring 146 mounted to the side plate 134 and 147 pulls the end of the pivotally mounted cam follower 140 down so that it is in the upright position with the lower portion 144 of the cam follower resting against the stop portion 145 of the side plate.

The cam track is illustrated in greater detail in FIG. 8 which depicts two linear cams 150, 151 that may be attached to the bottom of the moving platen, one of which is the activating means for the registration gate and the other which is the activating means for the arm assembly. During scanning from right to left the cam follower 140 is depressed by the raised portions of the cam track. As can be seen by viewing both cam tracks, the time $t_3$ is the start of scan position to the release of paper by the separation gate, the time $t_4$ is the time of release of paper by the separation gate to the registration gate and the time $t_2$ is the time from lowering the registration gate through the entire scanning of the document. It should be noted that during the time $t_2$ the separation gate cam surface is not returned to the standby condition but rather is slightly elevated to provide the kinematic correction on the height adjustment of the separation gate as described above. While being simple the separation registration gate activating mechanism is also very accurate and consistent since it is mechanically activated and controlled by the position of the moving platen and serves to accurately separate, register and feed copy sheets in timed sequence with the position of the original on the copying platen.

Figure 9:
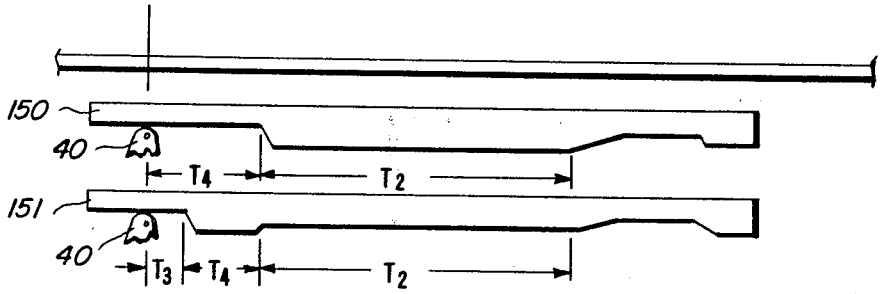
FIG. 9 is a side view of the single element separation registration gate illustrating the separation angle.

Referring once again to FIG. 5A wherein the side view of separator edge 105 with separation face 110 is depicted to be at an angle to the horizontal. While any suitable separation angle may be used the best balance between separating successive sheets and minimizing damage to the lead edge of sheets is with a separation angle of from about 45° to about 55°. The separation angle $\alpha$ is the angle of the face of the separation gate relative to the plane of the incoming sheet as illustrated in FIG. 9. With angles more than about 55° there is a greater propensity for the sheet to jump over the face or edge of the separation gate and with angles less than about 45° the propensity for lead edge damage of the copy is increased. This is experienced since the separation gate is rotated down past the level of the lead edge of the sheet when it is retracted from the separator position and the sheet is held in place by paper guide 111 to permit the sheet to be fed forward to the registration gate and during this operation the face of the separation gate gently pushes the lead edge of the separated sheet back toward the paper supply a small distance in order to clear the path for the sheet. In so doing if the angle between the copy sheet and the face of the separation gate is too large, the separation gate will tend to damage the copy sheet by way of tearing or curling the lead edge when it is rotated down past the lead edge of the copy sheet to the non separation position. Optimum balance between the propensity for sheets jumping over the face of the separation gate and damaging the lead edge of sheets is achieved with a separation angle of about 50°.

While the sheet and the plane of the separating registration gate are depicted as being horizontal it should be noted that they may be slightly pitched. For example, the path of the incoming sheet may be slightly inclined to the horizontal or the separation gate may be slightly pitched relative to the horizontal as depicted in FIG. 5A. In any of these configurations the important relationship is the angle of the separation gate face relative to the plane of the incoming sheet. This relationship exists for sheet feeding devices that are generally characterized as being high inertial feeding, low normal force devices such as the continuously running paddle wheel of this system. In these devices a continuously running paddle wheel positioned on top of a stack of sheets to be fed gently urges the top sheet to separate from the next successive sheet and proceed to the separation gate. The normal force on the separated sheet is relatively low and does not damage the copy sheet while constantly nudging it against the separation gate. The friction between the lead edge of the paper and the separation gate face holds the sheet from further forward travel. This is in sharp contrast to the high normal force feeding system where a feed roll is urged against a stack of sheets and separates and feeds the top sheet. Within the above range of angles between the separation gate face and the plane of copy sheet transport the higher the friction between the lead edge of the copy sheet being separated and the separation gate, the greater the permissible separation angle $\alpha$ without the lead edge jumping over it.

In the sheet feeding process the paddle wheel gently urges the top sheet forward, the sheet reaches the separation gate and remains there until the gate is lowered while the paddle wheel continues to urge it forward. When the gate is lowered the sheet is urged forward by the paddle wheel to the registration gate. When the registration gate is lowered the pinch rolls pivot up and the sheet is driven forward. At the same time the trailing edge of the top sheet has cleared the paddle wheel and the paddle wheel now urges the second sheet forward toward the separation gate. The separation registration gate system described herein provides a simple and inexpensive device in which to stop the second sheet from interferring with the registration and subsequent feeding of the top sheet.

The patents referred to specifically in the detailed description of this application are intended to be incorporated by reference into the description.

In accordance with the invention, a reproducing apparatus with an automatic sheet separation and registration actuation apparatus is provided. It has the advantage of being directly automatically responsive to the position of the moving document platen during its scanning operation and directly actuating the separation and registration assembly. Its simplicity of design and operation make its use in compact low-cost reproducing machines attractive. In addition its simplicity obviates the need for complex electromechanical devices to intermittently actuate the sheet feeding device or the sheet separation and registration member.

While this invention has been described with reference to the specific embodiment described, it will be apparent to those skilled in the art that many alternatives, modifications or variations may be made by those skilled in the art. Accordingly, it is intended to embrace all such alternatives and modifications as may fall within the spirit and scope of the appended claims.

We claim:

1. Reproducing apparatus comprising a stationary optical system, a platen to support a document to be reproduced, means to transport said platen carrying a document to be reproduced across said stationary optical system, a copy sheet feeding apparatus and a copy sheet registration apparatus to feed a copy sheet in synchronism with the transport of a document by said moving platen, said platen having associated therewith mechanical means to actuate said copy sheet registration apparatus and means associated with said copy sheet registration apparatus responsive to said platen actuating means to directly actuate said copy sheet registration apparatus.

2. The reproducing apparatus of claim 1 wherein said mechanical means associated with said platen for actuating said copy sheet registration apparatus comprises a linear reciprocating cam mounted to the underside of said platen and wherein said means responsive to said platen actuating means comprises push rod means having a cam follower at one end urged into the linear cam track.

3. The reproducing apparatus of claim 2 wherein said responsive means further includes registration apparatus actuating means at the other end of said push rod means.

4. The reproducing apparatus of claim 3 wherein said registration actuating means comprises a gate spring actuating member which urges said push rod and thereby the cam follower into the cam track and which actuates the registration apparatus responsive to the cam follower push rod assembly being urged by said linear cam.

5. The reproducing apparatus of claim 4 wherein said cam follower is spring biased in the linear reciprocating cam track and is thereby responsive thereto only during the platen scanning cycle.

6. The reproducing apparatus of claim 4 wherein said registration apparatus comprises at least one single element dual function separation registration gate having a first sheet separation edge at its first sheet engaging end and a second sheet registration gate at its opposite end, said single element gate being movably mounted in said sheet feeding path for reciprocation between a sheet separation position and a sheet registration position by said push rod assembly.

7. The reproducing apparatus of claim 6 wherein said single element dual function gate is pivotally mounted about its registration gate.

8. The reproducing apparatus of claim 7 further including a second linear reciprocating cam on said platen, a second cam follower push rod assembly and means responsive to activation of said second push rod assembly to retract said registration gate from the sheet feeding path so that the registered sheet may be fed in a forward direction.

9. The reproducing apparatus of claim 1 wherein said copy sheet feeding apparatus includes means for continuously feeding the top sheet of a stack of sheets.

10. The registration apparatus of claim 9 wherein said continuous feeding means comprises a continuously driven paddlewheel in feeding engagement with the top sheet in a stack of sheets.

* * * * *